US010139745B2

(12) United States Patent
Nakamoto et al.

(10) Patent No.: US 10,139,745 B2
(45) Date of Patent: Nov. 27, 2018

(54) TONER

(71) Applicant: CANON KABUSHIKI KAISHA, Tokyo (JP)

(72) Inventors: Atsushi Nakamoto, Tokyo (JP); Makoto Fukatsu, Suntou-gun (JP); Manami Haraguchi, Yokohama (JP); Masayoshi Kato, Tokyo (JP); Kei Inoue, Yokohama (JP); Kazuyuki Sato, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/146,585

(22) Filed: May 4, 2016

(65) Prior Publication Data

US 2016/0327883 A1 Nov. 10, 2016

(30) Foreign Application Priority Data

May 8, 2015 (JP) ..... 2015-095774

(51) Int. Cl.

| | |
|---|---|
| ***G03G 9/08*** | (2006.01) |
| ***G03G 9/097*** | (2006.01) |
| *G03G 15/08* | (2006.01) |

(52) U.S. Cl.

CPC ..... *G03G 9/09733* (2013.01); *G03G 9/0821* (2013.01); *G03G 9/0827* (2013.01); *G03G 15/08* (2013.01)

(58) Field of Classification Search

CPC ..... G03G 9/09733; G03G 9/0821; G03G 9/0827; G03G 15/08

See application file for complete search history.

(56) References Cited

U.S. PATENT DOCUMENTS

2011/0159425 A1* 6/2011 Itabashi ..... G03G 9/08706 430/108.2
2014/0170549 A1* 6/2014 Tsunemi ..... G03G 9/097 430/108.1

FOREIGN PATENT DOCUMENTS

| | | | |
|---|---|---|---|
| JP | 2694572 | A | 12/1997 |
| JP | 2009-42571 | A | 2/2009 |
| WO | 2013027397 | * | 2/2013 |

* cited by examiner

*Primary Examiner* — Thorl Chea

(74) *Attorney, Agent, or Firm* — Canon U.S.A. Inc., IP Division

(57) ABSTRACT

A toner according to the present disclosure maintains high transfer efficiency for the long term and obtains images which are not affected by toner base particles easily, which exhibit excellent charge stability, and which exhibit less fogging, wherein the toner is obtained by making inorganic fine particles and charge control particles, which satisfy specific conditions, present on the surfaces of toner base particles so as to satisfy a specific coverage relationship.

1 Claim, 5 Drawing Sheets

TONER

BACKGROUND

Field of the Disclosure

The present disclosure relates to a toner used in, for example, an image forming apparatus for performing image forming by using electrophotography.

Description of the Related Art

In recent years, copying machines and printers by using the electrophotography have been required to have higher image quality, longer lifetimes, and higher speeds. Therefore, high definition images have to be provided while the load on the toner increases.

Japanese Patent Laid-Open No. 2009-42571 proposes a technique to externally add silicon element-containing oxide fine particles, which have been subjected to a hydrophobic treatment and which have particle diameters of about 70 to 150 nm, in order to solve problems such as reduction in transfer efficiency resulting from abrasion of toner.

Meanwhile, in order to make a toner carry electric charges, the triboelectric chargeability of a resin serving as a component of the toner may also be utilized. Japanese Patent No. 2694572 proposes a technique to disperse a highly hydrophobic charge control agent, which includes a salicylic acid derivative, into a toner binding resin in order to obtain high, stable chargeability.

SUMMARY OF THE DISCLOSURE

Even when the highly hydrophobic inorganic fine particles having large particle diameters are externally added in order to maintain high transfer efficiency for the long term and the highly hydrophobic salicylic acid based charge control agent is further introduced to facilitate the charge stability, fogging may occur. The reason for this is considered to be that when toner base particles come into contact with other members, e.g., developing rollers and developing blades, electric charges are diffused from the contact portion.

The present disclosure was made in consideration of such problems, and an object is to make highly hydrophobic inorganic fine particles having large particle diameters and highly hydrophobic charge control particles present on the toner surfaces in such a way that toner base particles do not come into contact with other members so as to prevent diffusion of electric charges and obtain high quality images for the long term.

The present disclosure relates to a toner, in which inorganic fine particles and charge control particles are present on the surfaces of toner base particles, wherein the inorganic fine particles satisfy the following conditions i) and ii), i) the number average particle diameter is 90 nm or more ii) the value produced by dividing the rate of change in the mass of the inorganic fine particles by the specific surface area of the inorganic fine particles is 0.05 (%·g/m$^2$) or less, wherein the rate of change in the mass of the inorganic fine particles is calculated by a following formula:

$$(TGA2-TGA1)\times 100/TGA1$$

in the formula, the mass of the inorganic fine particles, which are left to stand for 24 hours or more in an environment at a temperature of 23° C. and a relative humidity of 5%, is defined "TGA1", and the mass of the inorganic fine particles, which are further left to stand for 1 hour in an environment at a temperature of 30° C. and a relative humidity of 80%, is defined "TGA2" the charge control particles have the charge attenuation factor of 10% or less, and the toner base particle coverage $H_b$ of the inorganic fine particles and the toner base particle coverage $H_c$ of the charge control particles satisfy Formula (1) below.

$$H_b > -\frac{r_b(R+r_b)^2}{r_c(R+r_c)^2}\cdot H_c + \frac{\sqrt{3}\pi}{18}\frac{r_b(R+r_b)^2}{R^3}\times 100 \qquad \text{Formula (1)}$$

(in the formula, R represents the number average particle diameter of the toner base particles, $r_b$ represents the number average particle diameter of the inorganic fine particles, and $r_c$ represents the number average particle diameter of the charge control particles)

Also, the present disclosure relates to a toner, in which inorganic fine particles and charge control particles are present on the surfaces of toner base particles, wherein the inorganic fine particles satisfy the following conditions i) and ii), i) the number average particle diameter is 90 nm or more ii) the value produced by dividing the rate of change in the mass of the inorganic fine particles by the specific surface area of the inorganic fine particles is 0.05 (%·g/m$^2$) or less, wherein the rate of change in the mass of the inorganic fine particles is calculated by a following formula:

$$(TGA2-TGA1)\times 100/TGA1$$

in the formula, the mass of the inorganic fine particles, which are left to stand for 24 hours or more in an environment at a temperature of 23° C. and a relative humidity of 5%, is defined "TGA1" and, the mass of the inorganic fine particles, which are further left to stand for 1 hour in an environment at a temperature of 30° C. and a relative humidity of 80%, is defined "TGA2", the charge control particle contains a polymer compound having at least a partial structure represented by General formula (1) above, and the toner base particle coverage $H_b$ of the inorganic fine particles and the toner base particle coverage $H_c$ of the charge control particles satisfy Formula (1) above.

Further features of the present disclosure will become apparent from the following description of exemplary embodiments with reference to the attached drawings.

DESCRIPTION OF THE EMBODIMENTS

The present inventors made highly hydrophobic inorganic fine particles having large particle diameters and highly hydrophobic charge control particles present on the toner base particle surfaces in such a way that toner base particles did not come into contact with other members and found that the transfer efficiency was able to be maintained in the long term and that excellent charge stability was obtained in spite of the hydrophobicity of the toner base particles.

It was considered from these investigation results that the toner base particle surfaces had to be covered with the inorganic fine particles and the charge control particles at specific coverages in order to avoid contact between the toner base particle and other members. Then, Formula (1) described below was introduced as the condition of the coverage in the present disclosure, and examination and verification were performed. Consequently, it was found that the condition was effective in reproducing the above-described investigation results, and the present disclosure was made.

$$H_b > -\frac{r_b(R+r_b)^2}{r_c(R+r_c)^2}\cdot H_c + \frac{\sqrt{3}\pi}{18}\frac{r_b(R+r_b)^2}{R^3}\times 100 \qquad \text{Formula (1)}$$

(in the formula, R represents the number average particle diameter of the toner base particles, $r_b$ represents the number average particle diameter of the inorganic fine particles, and $r_c$ represents the number average particle diameter of the charge control particles)

A technology to cover the toner surface with inorganic fine particles having a particle diameter of about 100 nm to maintain transfer efficiency for the long term is known. In this case, degradation of the chargeability of the toner is caused easily.

Triboelectric charge generated on the toner surface is susceptible to the amount of water on the toner surface.

Water molecules are involved in the transfer of electric charge to a great extent. If the desorption frequency of water molecule from the toner surface increases at high humidity, the charge leakage rate increases so as to cause decrease in the saturation charge amount and decrease in the rise rate of charging.

That is, even when a charge control agent is made to be present on the toner surface for the purpose of providing a high triboelectric chargeability and high charge stability, the purpose is not achieved in a state in which water molecules are attached to a toner outermost member easily.

However, the toner configuration according to the present disclosure solves the problem.

Figure 1:
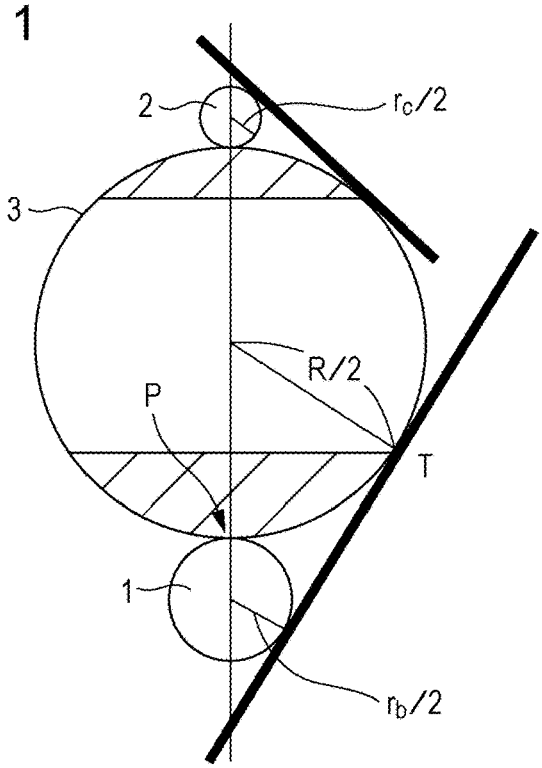
FIG. 1 shows a schematic diagram of a toner base particle and an inorganic fine particle on the toner base particle surface, according to one or more embodiment of the subject disclosure.

FIG. 1 shows a projection diagram schematically illustrating a state in which a toner base particle 3 according to the present disclosure and each of an inorganic fine particle 1 and a charge control particle 2 arranged on the surface of the toner base particle 3 are tangent to a plane.

In this state, the diagonally shaded areas on the surface of the toner base particle 3 do not come into contact with a plane.

Figure 2:
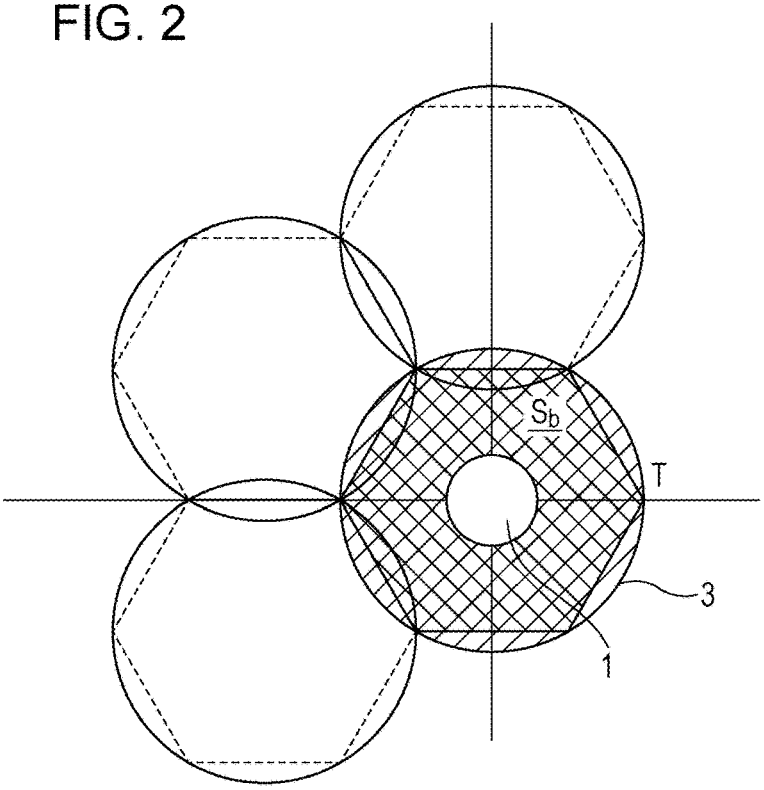
FIG. 2 shows a schematic diagram of an arrangement, in which an inorganic fine particle prevents contact between a toner base particle surface and a plane, according to one or more embodiment of the subject disclosure.

The case where the surface of the entire toner base particle 3 is filled with the diagonally shaded areas by arranging inorganic fine particles 1 on the surface of the toner base particle 3 while the inorganic fine particles 1 are arranged in such a way that the number thereof is minimized is considered. The projection diagram of the arrangement is as shown in FIG. 2.

In this regard, the toner base particle 3 is assumed to be sufficiently larger than the inorganic fine particle 1 and is approximated by a plane.

The area covered by the inorganic fine particle 1 in such a way that the surface of the toner base particle 3 does not come into contact with the plane is a hexagonal crosshatched area Sb shown in FIG. 2 and is represented by Formula (3) below.

$$S_b = \frac{3\sqrt{3}R^3 r_b}{2(R+r_b)^2} \qquad \text{Formula (3)}$$

The same goes for the case where a charge control particle 2 is arranged in place of the inorganic fine particle 1.

Therefore, the area Sc covered by the presence of a charge control particle 2 in such a way that the surface of the toner base particle 3 does not come into contact with the plane is represented by Formula (4) below.

$$S_c = \frac{3\sqrt{3}R^3 r_c}{2(R+r_c)^2} \qquad \text{Formula (4)}$$

In this regard, when the number of inorganic fine particles 1 present on the toner base particle surface is $n_b$ and the number of charge control particles 2 present on the toner base particle surface is $n_c$, the condition for avoiding the surface of the toner base particle 3 from coming into contact with a plane is Formula (5) below.

$$\frac{3\sqrt{3}R^3 r_b}{2(R+r_b)^2}\cdot n_b + \frac{3\sqrt{3}R^3 r_c}{2(R+r_c)^2}\cdot n_c > \pi R^2 \qquad \text{Formula (5)}$$

The toner base particle 3 coverage $H_b$ of the inorganic fine particles 1 and the toner base particle 3 coverage $H_c$ of the charge control particles 2 are considered to be the proportions of projected areas of the inorganic fine particles and the charge control particles, respectively, relative to the surface area of the toner base particle and, therefore, are represented by the following formulae.

$$H_b = n_b\times\pi(r_b/2)^2/4\pi(R/2)^2\times 100 = 25 n_b\times r_b^2/R^2$$

$$H_c = n_c\times\pi(r_c/2)^2/4\pi(R/2)^2\times 100 = 25 n_c\times r_c^2/R^2$$

Hence, $$n_b = H_b R^2/25 r_b^2$$

$$n_c = H_c R^2/25 r_c^2$$

Formula (5) is transformed into Formula (1) by using these.

$$H_b > -\frac{r_b(R+r_b)^2}{r_c(R+r_c)^2}\cdot H_c + \frac{\sqrt{3}\pi}{18}\frac{r_b(R+r_b)^2}{R^3}\times 100 \quad \text{Formula (1)}$$

That is, in the case where the inorganic fine particles 1 and charge control particles 2 are present on the surface of the toner base particle 3 at coverages satisfying Formula 1, the toner base particle does not come into contact with other planes.

The toner base particle comes into contact with other members with a highly hydrophobic inorganic fine particle 1 or a highly hydrophobic charge control particle 2 therebetween, so that high chargeability and high charge stability are obtained by establishing a state in which a water molecule is not attached to a contact portion easily.

In the present disclosure, the sum total of the coverage of the inorganic fine particles and the coverage of the charge control particles is more preferably 100% or less. In the case of 100% or less, it is possible to make isolation of inorganic fine particles difficult and charge is stabilized. Although the reason for this is not certain, it is considered to be as described below. In the case where the charge signs of the inorganic fine particles and the charge control particles are the same, externally added inorganic fine particles are attached directly to the toner base particle so as to avoid charge control particles. However, in the case where the sum total of the coverages is more than 100%, it is difficult for the inorganic fine particles to avoid the charge control particles, and the inorganic fine particles are attached from above the charge control particles, so that the inorganic fine particles are brought into a state of being isolated easily.

In the case where the coverage of the inorganic fine particles satisfies Formula (2), a better transfer efficiency is obtained. This is because a spacer effect of the inorganic fine particles is sufficiently obtained by the coverage of the inorganic fine particles being more than the lower limit specified in Figure (2) and the transfer efficiency further increases. Meanwhile, isolation of the inorganic fine particles is suppressed and the charge is stabilized by the coverage of the inorganic fine particles being less than the upper limit specified in Figure (2). The coverage of the charge control particles is specified as more preferably 80% or less. Isolation of the charge control particles is suppressed and higher charge stability is obtained by the coverage of the charge control particles being specified as 80% or less.

Also, the average circularity of the toner base particles according to the present disclosure is more preferably 0.93 or more. In the case where the average circularity of the toner base particles is 0.93 or more, the model represented by Formula (1) is reproduced precisely.

The inorganic fine particles used in the present disclosure will be described below in detail.

Regarding the inorganic fine particles according to the present disclosure, in order to maintain the transfer efficiency after endurance, i) the average particle diameter of the inorganic fine particles has to be 90 nm or more (hereafter may be referred to as "Condition A").

This is because if the average particle diameter is less than 90 nm, the inorganic fine particles are buried under the toner base particle surface because of the endurance and a sufficient spacer effect is not exerted after the endurance. As a result of intensive investigation of the present inventors, it was found that if the average particle diameter was 90 nm or more, a sufficient spacer effect was exerted after the endurance.

Also, regarding the inorganic fine particles according to the present disclosure, ii) the value produced by dividing the rate of change in the mass of the inorganic fine particles by the specific surface area of the inorganic fine particles has to be 0.05 (%·g/m$^2$) or less (hereafter may be referred to as "Condition B"). The rate of change in the mass of the inorganic fine particles is calculated by a following formula:

$$(TGA2-TGA1)\times 100/TGA1.$$

In the formula, the mass of the inorganic fine particles, which are left to stand for 24 hours or more in an environment at a temperature of 23° C. and a relative humidity of 5%, is defined "TGA1" and, the mass of the inorganic fine particles, which are further left to stand for 1 hour in an environment at a temperature of 30° C. and a relative humidity of 80%, is defined "TGA2".

If this value is more than 0.05 (%·g/m$^2$), electric charges are diffused through the inorganic fine particles, so that sufficient charge is not obtained and it is difficult to stabilize the charge. Inorganic fine particles satisfying Condition B are obtained easily by, for example, subjecting the inorganic fine particle surfaces to a hydrophobic treatment.

Regarding the inorganic fine particles satisfying Condition A, for example, silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride are used, although silica can be used from the viewpoint of charge control. Examples of inorganic fine particles satisfying both Condition A and Condition B include silica fine particles Sciqas series produced by Sakai Chemical Industry Co., Ltd., and silica fine particles TG-C190 series produced by Cabot.

The charge control particles used in the present disclosure will be described below in detail.

The charge control particles according to the present disclosure have to satisfy Condition C or Condition D below.

Condition C: The charge attenuation factor of the charge control particles is 10% or less. A measurement method of the charge attenuation factor describes below.

Condition D: The charge control particles contain a polymer compound having at least a partial structure represented by General formula (1).

General formula (1)

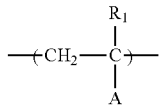

(in General formula (1), $R_1$ represents a hydrogen atom or an alkyl group, and A represents a bonding site for bonding to a structure represented by General formula (2))

General formula (2)

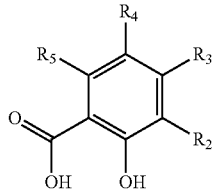

(in General formula (2), $R_2$ to $R_5$ represent independently a hydrogen atom, an alkyl group having a carbon number of 1 to 6, a halogen atom, a cyano group, a nitro group, or a partial structure represented by General formula (1), at least one of $R_2$ to $R_5$ is the partial structure represented by General formula (1), and regarding the partial structure represented by General formula (1), the bonding site A in the partial structure represented by General formula (1) has a bonding function)

Condition C will be described.

Regarding the charge control particles used in the present disclosure, the charge attenuation factor is 10% or less. If the charge attenuation factor is more than 10%, electric charges are diffused through the charge control particles, so that sufficient charge is not obtained and it is difficult to stabilize the charge.

The compound specified by Condition D is a polymer compound satisfying the above-described charge attenuation characteristics.

Examples of the alkyl group as $R_1$ in General formula (1) include a methyl group, an ethyl group, an n-propyl group, an isopropyl group, and an n-butyl group.

From the viewpoint of polymerizability of a monomer, $R_1$ in General formula (1) can be a hydrogen atom or a methyl group.

Examples of the alkyl group as $R_2$ to $R_5$ in General formula (2) include a methyl group, an ethyl group, an n-propyl group, an isopropyl group, an n-butyl group, an isobutyl group, a sec-butyl group, and a tert-butyl group.

Examples of the halogen atom include a fluorine atom, a chlorine atom, a bromine atom, and an iodine atom.

In General formula (2), $R_2$ to $R_5$ represent independently a substituent listed above. These may be further substituted, and there is no particular limitation as long as the above-described charge attenuation characteristics of the polymer compound are not impaired. Examples of substituents usable in this case include alkoxy groups, e.g., a methoxy group and an ethoxy group, amino groups, e.g., an N-methylamino group and an N,N-dimethylamino group, acyl groups, e.g., an acetyl group, and halogen atoms, e.g., a fluorine atom and a chlorine atom.

In General formula (2), at least one of $R_2$ to $R_5$ is the partial structure represented by General formula (1). The bonding position is not specifically limited and is any one of $R_2$ to $R_5$. At least two partial structures represented by General formula (1) may be bonded.

In General formula (2), R2 to R5 are independently optionally selected from the substituents listed above, a hydrogen atom, and a partial structure represented by General formula (1), although the case where one is the partial structure (unit) represented by General formula (1) and the others are hydrogen atoms is advantageous from the viewpoint of production.

The above-described polymer compound may be a copolymer having the partial structure represented by General formula (1) and a partial structure represented by General formula (3).

General formula (3)

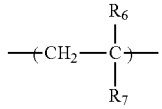

(in General formula (3), $R_6$ represents a hydrogen atom or an alkyl group and $R_7$ represents a phenyl group, a carboxy group, an alkoxycarbonyl group, or a carboxyamide group)

In General formula (3), examples of the alkyl group as $R_6$ include a methyl group, an ethyl group, an n-propyl group, an isopropyl group, and an n-butyl group. In General formula (3), $R_6$ is optionally selected from the substituents listed above and a hydrogen atom, although $R_6$ can be a hydrogen atom or a methyl group from the viewpoint of polymerizability of a monomer.

In General formula (3), examples of the alkoxycarbonyl group as $R_7$ include a methoxycarbonyl group, an ethoxycarbonyl group, an n-propoxycarbonyl group, an isopropoxycarbonyl group, an n-butoxycarbonyl group, an isobutoxycarbonyl group, a sec-butoxycarbonyl group, a tert-butoxycarbonyl group, a dodesoxycarbonyl group, 2-ethylhexoxycarbonyl group, a stearoxycarbonyl group, a phenoxycarbonyl group, and a 2-hydroxyethoxycarbonyl group. Examples of the carboxyamide group include an N-methylamide group, an N,N-dimethylamide group, an N,N-diethylamide group, an N-isopropylamide group, an N-tert-butylamide group, and an N-phenylamide group.

In General formula (3), $R_7$ represents a substituent listed above. These may be further substituted, and there is no particular limitation as long as the polymerizability of a monomer is not significantly impaired. Examples of substituents usable in this case include alkoxy groups, e.g., a methoxy group and an ethoxy group, amino groups, e.g., an N-methylamino group and an N,N-dimethylamino group, acyl groups, e.g., an acetyl group, and halogen atoms, e.g., a fluorine atom and a chlorine atom.

In General formula (3), $R_7$ is optionally selected from the substituents listed above, a phenyl group, and a carboxy group, although $R_7$ can be a phenyl group or an alkoxycarbonyl group in order to satisfy the above-described charge attenuation characteristics.

The proportion of the partial structure represented by General formula (1) relative to the units constituting the copolymer is preferably 0.01 percent by mole to 30 percent by mole and more preferably 0.01 percent by mole to 15 percent by mole. If the unit represented by General formula (1) is less than 0.01 percent by mole, sufficient negative chargeability is not obtained. On the other hand, if the proportion is more than 30 percent by mole, high negative chargeability is obtained, although the charge attenuation factor may be more than 10%, so that charge control particles do not satisfy the present disclosure in some cases.

The molecular weight of the above-described polymer compound is preferably within the range of 3,000 to 100,000 on a weight average molecular weight (Mw) basis and more preferably within the range of 5,000 to 50,000. In the case where Mw is less than 3,000, when the polymer compound is contained in a toner, falling from the toner occurs easily, and soiling of a carrier, a developing member, a photoconductive drum, and the like may occur. On the other hand, in the case where Mw is more than 100,000, charge control particles having a particle diameter required for covering the toner surface are not obtained in some cases.

The constituent components of the toner according to the present disclosure will be described below in detail.

Known binder resins are usable for the toner according to the present disclosure and vinyl resins, e.g., styrene-acrylic resins, polyester resins, and hybrid resins, in which these resins are combined, are used.

Meanwhile, in a method in which toner particles are directly obtained by a polymerization method, monomers for producing them are used.

Specifically, styrene based monomers, e.g., styrene, o-(m-,p-)methylstyrene, and o-(m-,p-)ethylstyrene; acrylate monomers, e.g., methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and acrylic acid amide; methacrylate monomers, e.g., methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, and methacrylic acid amide; and olefinic monomers, e.g., butadiene, isoprene, and cyclohexene, can be used.

These are used alone or generally in appropriate combination in such a way that the theoretical glass transition temperature (Tg) described in "Polymer Handbook", (USA), 3rd edition, J. Brandrup and E. H. Immergut (editors), John Wiley & Sons, 1989, p. 209-277 of 40° C. to 75° C. is exhibited.

In the case where the theoretical glass transition temperature is lower than 40° C., problems associated with the storage stability and the durable stability of the toner occur easily. On the other hand, if the temperature is higher than 75° C., the transparency of the image is degraded in full color image forming using the toner.

In the present disclosure, in order to enhance the mechanical strength of the toner particles and control the molecular weight of the binder resin, a crosslinking agent may be used for synthesizing the binder resin.

Examples of bifunctional crosslinking agents as the crosslinking agents used for the toner according to the present disclosure include divinylbenzene, 2,2-bis(4-acryloxyethoxyphenyl)propane, 2,2-bis(4-methacryloxyphenyl)propane, diallylphthalate, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylate of each of polyethylene glycol #200, #400, and #600, dipropylene glycol diacrylate, propylene glycol diacrylate, polyester type diacrylate, and those in which the above-described diacrylate is replaced with dimethacrylate.

Examples of polyfunctional crosslinking agents include pentaerythritol triacrylate, trimethylolethane triacrylate, trimethylolpropane triacrylate, tetramethylolmethane tetraacrylate, oligoester acrylate, oligoester methacrylate, triallyl cyanurate, triallyl isocyanurate, and triallyl trimellitate.

From the viewpoints of fixability and offset resistance of the toner, preferably 0.05 to 10 parts by mass and more preferably 0.1 to 5 parts by mass of these crosslinking agents are used relative to 100 parts by mass of the above-described monomer.

The toner according to the present disclosure is either a magnetic toner or a non-magnetic toner. The following magnetic materials can be used as the magnetic toner. That is, examples thereof include iron oxides, e.g., magnetite, maghemite, and ferrite, iron oxides containing other metal oxides, metals such as Fe, Co, and Ni, alloys of these metals and metals such as Al, Co, Cu, Pb, Mg, Ni, Sn, Zn, Sb, Be, Bi, Cd, Ca, Mn, Se, Ti, W, and V, and mixtures thereof.

Examples of the magnetic material include ferrosol ferric oxide ($Fe_3O_4$), γ-iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodymium iron oxide ($NdFe_2O_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), an iron powder (Fe), a cobalt powder (Co), and a nickel powder (Ni).

The above-described magnetic materials are used alone or in combination.

A magnetic material particularly suitable for the present disclosure is a fine powder of ferrosol ferric oxide or γ-iron sesquioxide.

From the viewpoint of developability of the toner, the average particle diameters of these magnetic materials are 0.1 to 2 μm (preferably 0.1 to 0.3 μm), and regarding the magnetic characteristics under application of 795.8 kA/m, the coercive force is 1.6 to 12 kA/m, the saturation magnetization is 5 to 200 $Am^2/kg$ (preferably 50 to 100 $Am^2/kg$), and the residual magnetization is 2 to 20 $Am^2/kg$.

The amount of addition of these magnetic materials is 10 to 200 parts by mass and preferably 20 to 150 parts by mass relative to 100 parts by mass of the binder resin.

Meanwhile, in the case where non-magnetic toner is used, known colorants such as various known dyes and pigments are used as the colorant.

Examples of magenta colorants include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, and 209; C.I. Pigment Violet 19; and C.I. Vat Red 1, 2, 10, 13, 15, 23, 29, and 35.

Examples of cyan colorants include C.I. Pigment Blue 2, 3, 15:1, 15:3, 16, 17, 25, and 26; C.I. Vat Blue 6; C.I. Acid Blue 45; and copper phthalocyanine pigments in which a phthalocyanine skeleton has 1 to 5 phthalimidomethyl groups as substituents.

Examples of yellow colorants include C.I. Pigment Yellow 1, 2, 3, 4, 5, 6, 7, 10, 11, 12, 13, 14, 15, 16, 17, 23, 65, 73, 74, 83, 93, 155, and 180; C.I. Solvent Yellow 9, 17, 24, 31, 35, 58, 93, 100, 102, 103, 105, 112, 162, and 163; and C.I. Vat Yellow 1, 3, and 20.

Regarding black colorants, for example, carbon black, aniline black, acetylene black, and those subjected to color toning to black by using the above-described yellow/magenta/cyan colorants are utilized.

The use amounts of these colorants are different depending on the type of the colorant, and the sum total of 0.1 to 60 parts by mass and preferably 0.5 to 50 parts by mass relative to 100 parts by mass of the binder resin is appropriate.

Specific examples of wax components usable in the present disclosure include petroleum wax, e.g., paraffin wax, microcrystalline wax, and petrolatum, and derivatives thereof, montan wax and derivatives thereof, hydrocarbon wax produced by a Fischer-Tropsch process and derivatives thereof, polyolefin wax typified by polyethylene and derivatives thereof, and natural wax, e.g., carnauba wax and candelilla wax, and derivatives thereof. Derivatives include oxides, block copolymers with a vinyl monomer, and graft-modified products.

In addition, alcohols, e.g., higher aliphatic alcohols, fatty acids, e.g., stearic acid and palmitic acid, acid amides and esters of those compounds, hydrogenated castor oil and derivatives thereof, plant wax, animal wax, and the like are mentioned.

These are used alone or in combination.

Regarding the amount of addition of the wax component, the sum total of contents is preferably 2.5 to 15.0 parts by mass and more preferably 3.0 to 10.0 parts by mass relative to 100 parts by mass of the binder resin.

If the content of the wax component is less than 2.5 parts by mass, oilless fixing is difficult. If the content of the wax component is more than 15.0 parts by mass, a large amount of excess wax component is present on the toner surface, and, as a result, predetermined charge characteristics are not obtained easily.

The toner according to the present disclosure exhibits sufficient charge characteristics by covering the toner base particle surfaces with the above-described charge control particles. For the purpose of adjusting the charge characteristics, already available charge control agents may be used in combination in accordance with a developing system in which the toner according to the present disclosure is used. For example, the following are mentioned as the charge control agents usable in combination.

Examples of charge control agents having negative chargeability include polymer compounds having a sulfonic acid group, a sulfonic acid salt group, or a sulfonic ester group, salicyclic acid derivatives and metal complexes thereof, monoazo metal compounds, acetylacetone metal compounds, aromatic oxycarboxylic acid, aromatic mono or polycarboxylic acid and metal salts, anhydrides, and esters thereof, phenol derivatives, e.g., bisphenol, urea derivatives, boron compounds, and calixarene.

Examples of charge control agents having positive chargeability include nigrosine modified products by using nigrosine, fatty acid metal salts, and the like, guanidine compounds, imidazole compounds, tributylbenzylammonium-1-hydroxy-4-naphtholsulfonic acid salts, quaternary ammonium salts, e.g., tetrabutylammonium tetrafluoroborate, onium salts, e.g., phosphonium salts, which are analogs of these, and lake pigments thereof, triphenylmethane dyes and lake pigments thereof (a lake-forming agent is tungstophosphoric acid, phosphomolybdic acid, phosphotungstomolybdic acid, tannic acid, lauric acid, gallic acid, ferricyanide, ferrocyanide, or the like), metal salts of higher fatty acids, diorganotin oxides, e.g., dibutyltin oxide, dioctyltin oxide, and dicyclohexyltin oxide, and diorganotin borates, e.g., dibutyltin borate, dioctyltin borate, and dicyclohexyltin borate.

A fluidity improver of less than 90 nm may be externally added as a fluidizer to the toner according to the present disclosure separately from the above-described inorganic fine particles. Regarding the fluidity improver, fine powders of, for example, silica, titanium oxide, alumina, double oxides thereof, and surface-treated products of those described above are used.

In the present disclosure, the number average particle diameter (D1) of the toner is preferably 3.0 to 15.0 μm and more preferably 4.0 to 12.0 μm from the viewpoints of charge stability and formation of high quality images.

The method for adjusting the number average particle diameter D1 of the toner according to the present disclosure is different depending on the method for manufacturing the toner particles.

For example, in the case of a suspension polymerization method, adjustment is performed by controlling the concentration of a dispersing agent used in preparation of an aqueous dispersion medium, a reaction agitation speed, a reaction agitation time, or the like.

The toner base particles according to the present disclosure are produced by various manufacturing methods.

For example, a knead-pulverization method in which a binder resin, a pigment, and a release agent are mixed and toner base particles are obtained through kneading, pulverization, and classification steps;

a suspension polymerization method in which a polymerizable monomer, a pigment, and a release agent are mixed, dispersed, or dissolved, granulation is performed in an aqueous medium, and toner base particles are obtained by a polymerization reaction;

a dissolution suspension method in which a binder resin, a pigment, and a release agent are dissolved or dispersively mixed into an organic solvent, granulation is performed in an aqueous medium, and, thereafter, toner base particles are obtained by removing the solvent;

an emulsion coagulation method in which fine particles of each of a binder resin, a pigment, and a release agent are finely dispersed into an aqueous medium, and toner base particles are obtained by coagulating them so as to have a toner particle diameter, and the like are mentioned.

The toner base particles according to the present disclosure may be produced by using any technique. However, the toner base particles can be obtained by a manufacturing method, in which granulation is performed in an aqueous medium, such as the suspension polymerization method, the dissolution suspension method, the emulsion coagulation method, or the like because the toner base particles having a high average circularity are obtained relatively easily.

In the case where the toner base particles are produced by the suspension polymerization method, the toner base particles are obtained through the following steps.

A step of preparing a polymerizable monomer composition by mixing a polymerizable monomer serving as the binder resin, a colorant, a wax component, a polymerization initiator, and the like A step of granulating particles of the polymerizable monomer composition by dispersing the polymerizable monomer composition into an aqueous medium A step of polymerizing the polymerizable monomer in the particles of the polymerizable monomer composition in the aqueous medium after the granulation Known polymerization initiators are mentioned as the polymerization initiator used in the suspension polymerization method, and examples thereof include azo compounds, organic peroxides, inorganic peroxides, organometallic compounds, and photopolymerization initiators.

Specific examples include azo polymerization initiators, e.g., 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile), and dimethyl 2,2'-azobis(isobutyrate), organic peroxide polymerization initiators, e.g., benzoyl peroxide, di-tert-butyl peroxide, tert-butylperoxyisopropyl monocarbonate, tert-hexylperoxybenzoate, and tert-butylperoxybenzoate, inorganic peroxide polymerization initiators, e.g., potassium persulfate and ammonium persulfate, redox initiators of hydrogen peroxide-ferrous base, BPO-dimethylaniline base, cerium(IV) salt-alcohol base, and the like.

Examples of photopolymerization initiators include initiators of acetophenone base, benzoin ether base, and ketal base.

These methods are used alone or in combination.

The concentration of the polymerization initiator is preferably within the range of 0.1 to 20 parts by mass and more preferably within the range of 0.1 to 10 parts by mass relative to 100 parts by mass of the polymerizable monomer.

The type of polymerization initiator used is different depending on the polymerization method. The polymerization initiators are used alone or in combination in consideration of the 10-hour half-life temperature.

The aqueous medium used in the suspension polymerization method can contain a dispersion stabilizer.

Known inorganic and organic dispersion stabilizers may be used as the above-described dispersion stabilizer.

Examples of the inorganic dispersion stabilizer include calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersion stabilizer include polyvinyl alcohol, gelatin, methyl cellulose, methyl hydroxypropyl cellulose, ethyl cellulose, carboxymethyl cellulose sodium salts, and starch.

Also, nonionic, anionic, and cationic surfactants may be used.

Examples include sodium dodecyl sulfate, sodium tetradecyl sulfate, sodium pentadecyl sulfate, sodium octyl sulfate, sodium oleate, sodium laurate, potassium stearate, and calcium oleate.

Among the above-described dispersion stabilizers, acid-soluble, water-insoluble inorganic dispersion stabilizer can be used in the present disclosure.

In the case where the aqueous dispersion medium is prepared by using the water-insoluble inorganic dispersion stabilizer, the dispersion stabilizer is used in a proportion within the range of preferably 0.2 to 2.0 parts by mass relative to 100 parts by mass of the polymerizable monomer from the viewpoint of stability of droplets of the polymerizable monomer composition in the aqueous medium.

In the present disclosure, the aqueous medium is prepared by using water within the range of preferably 300 to 3,000 parts by mass relative to 100 parts by mass of the polymerizable monomer.

A commercially available dispersion stabilizer may be used as the above-described dispersion stabilizer without being processed. However, the above-described water-insoluble inorganic dispersion stabilizer can be generated in a state of being agitated at a high speed in the water. In this case, a fine dispersion stabilizer having a uniform particle size is obtained.

For example, in the case where calcium phosphate is used as the dispersion stabilizer, fine particles of calcium phosphate are formed by mixing a sodium phosphate aqueous solution and a calcium chloride aqueous solution under high-speed agitation, so that a predetermined dispersion stabilizer is obtained.

In the case where the toner is produced by the emulsion coagulation method, for example, the toner base particles may be obtained through the following steps.

That is, the toner base particles are obtained through a step of preparing an aqueous dispersion of each of toner constituent components, e.g., the binder resin, the colorant, and the wax, (dispersion step), a step of mixing the resulting aqueous dispersion and forming aggregate particles by coagulation (coagulation step), a step of heating and fusing the aggregate particles (fusing step), a washing step, and a drying step.

In the step of dispersing each of the toner constituent components, a dispersing agent, e.g., a surfactant, may be used. Specifically, the toner constituent components and the surfactant are dispersed together into the aqueous medium. The aqueous dispersion is produced by a known method and, for example, media type dispersing machines, e.g., a rotary shearing homogenizer, a ball mill, a sand mill, and an attritor, and high-pressure counter collision type dispersing machines can be used.

Examples of the surfactant include water-soluble polymers, inorganic compounds, and ionic or nonionic surfactants. Highly dispersible ionic surfactants can be used from the viewpoint of dispersibility. In particular, anionic surfactants can be used.

From the viewpoints of washability and surface activity, the molecular weight of the surfactant is preferably 100 to 10,000 and more preferably 200 to 5,000.

Specific examples of the surfactant include water-soluble polymers, e.g., polyvinyl alcohol, methyl cellulose, carboxymethyl cellulose, and sodium polyacrylates; surfactants such as anionic surfactants, e.g., sodium dodecylbenzenesulfonate, sodium octadecylsulfate, sodium oleate, sodium laurate, and potassium stearate; cationic surfactants, e.g., laurylamine acetate and lauryltrimethylammonium chloride; amphoteric surfactants, e.g., lauryldimethylamine oxide; and nonionic surfactants, e.g., polyoxyethylene alkyl ether, polyoxyethylene alkylphenyl ether, and polyoxyethylene alkylamine; and inorganic compounds, e.g., tricalcium phosphate, aluminum hydroxide, calcium sulfate, calcium carbonate, and barium carbonate.

These may be used alone or in combination, as necessary.

There is no particular limitation regarding what method may be used for forming the aggregate particles. For example, a method in which a pH adjuster, a coagulant, a stabilizer, and the like are added and mixed into an aqueous dispersion mixed solution and a temperature, a mechanical power (agitation), and the like are applied can be used.

There is no particular limitation regarding what material may be used for the pH adjuster. Alkalis, e.g., ammonia and sodium hydroxide, and acids, e.g., nitric acid and citric acid, are used.

There is no particular limitation regarding what material may be used for the coagulant. Examples thereof include inorganic metal salts, e.g., sodium chloride, magnesium carbonate, magnesium chloride, magnesium nitrate, magnesium sulfate, calcium chloride, and aluminum sulfate, and divalent or higher valent metal complexes.

Surfactants are mainly used as the above-described stabilizer.

There is no particular limitation regarding what material may be used for the surfactant. Examples thereof include water-soluble polymers, e.g., polyvinyl alcohol, methyl cellulose, carboxymethyl cellulose, and sodium polyacrylates; surfactants such as anionic surfactants, e.g., sodium dodecylbenzenesulfonate, sodium octadecylsulfate, sodium oleate, sodium laurate, and potassium stearate; cationic surfactants, e.g., laurylamine acetate and lauryltrimethylammonium chloride; amphoteric surfactants, e.g., lauryldimethylamine oxide; and nonionic surfactants, e.g., polyoxyethylene alkyl ether, polyoxyethylene alkylphenyl ether, and polyoxyethylene alkylamine; and inorganic compounds, e.g., tricalcium phosphate, aluminum hydroxide, calcium sulfate, calcium carbonate, and barium carbonate. These may be used alone or in combination, as necessary.

The average particle diameter of aggregate particles formed here is not specifically limited and is usually controlled so as to become nearly equal to the average particle diameter of the toner base particles to be obtained. Control is performed easily by, for example, setting or changing the temperature during addition and mixing of the coagulant and the like and the conditions of the agitation and mixing. In order to prevent melt-adhesion between toner particles, the pH adjuster, the surfactant, and the like may be added appropriately.

In the fusing step, toner base particles are formed by heating and fusing the aggregate particles.

The heating temperature only needs to be set between the glass transition temperature (Tg) of the resin contained in the aggregate particles and the decomposition temperature of the resin. For example, aggregate particles are fused and united by stopping the progress of coagulation by addition of a surfactant, pH adjustment, or the like under the same agitation as in the coagulation step and performing heating to a temperature higher than or equal to the glass transition temperature of the resin in the aggregate particle.

The heating time may be such that fusion occurs sufficiently. Specifically the heating time may be about 10 minutes to 10 hours.

A step of forming a core-shell structure by adding and mixing a fine particle dispersion liquid, in which fine particles are dispersed, so as to attach the fine particles to the aggregate particles (attachment step) may be further included before or after the fusing step.

The surfaces of the thus produced toner base particles are covered with the inorganic fine particles and the charge control particles, so that the toner according to the present disclosure is produced.

Regarding the method for covering the surfaces of the toner base particles with the inorganic fine particles and the charge control particles, a dry method, in which a high speed flow type mixer, e.g., Henschel Mixer, is used, or a wet method, in which fine particle dispersion is coagulated and fixed in an aqueous medium or the like, may be used.

Each of the methods is appropriately selected in accordance with the particle diameter and the chemical properties of the fine particles used for covering. In the present disclosure, the dry method can be particularly used as the method for performing covering with the inorganic fine particles and the wet method can be particularly used as the method for performing covering with charge control particles.

Next, image forming by using the toner according to the present disclosure will be described in detail.

Figure 3:
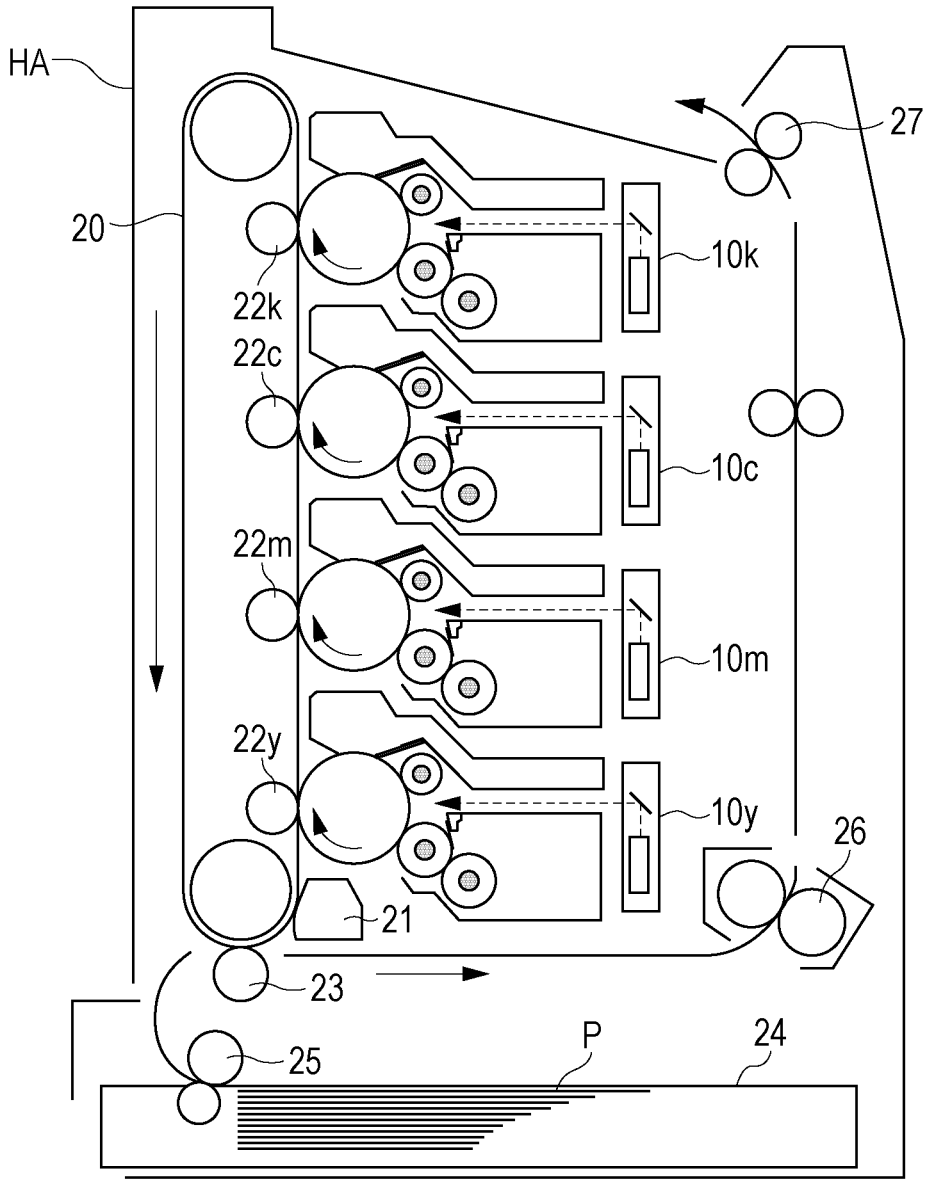
FIG. 3 shows a schematic diagram of an image forming apparatus main body, according to one or more embodiment of the subject disclosure.

FIG. 3 shows a schematic configuration diagram of an image forming apparatus in which the toner according to the present disclosure is used.

The image forming apparatus HA shown in FIG. 3 is a full color laser printer for use in an electrophotographic process.

The schematic configuration of the entire image forming apparatus HA will be described below.

Figure 4:
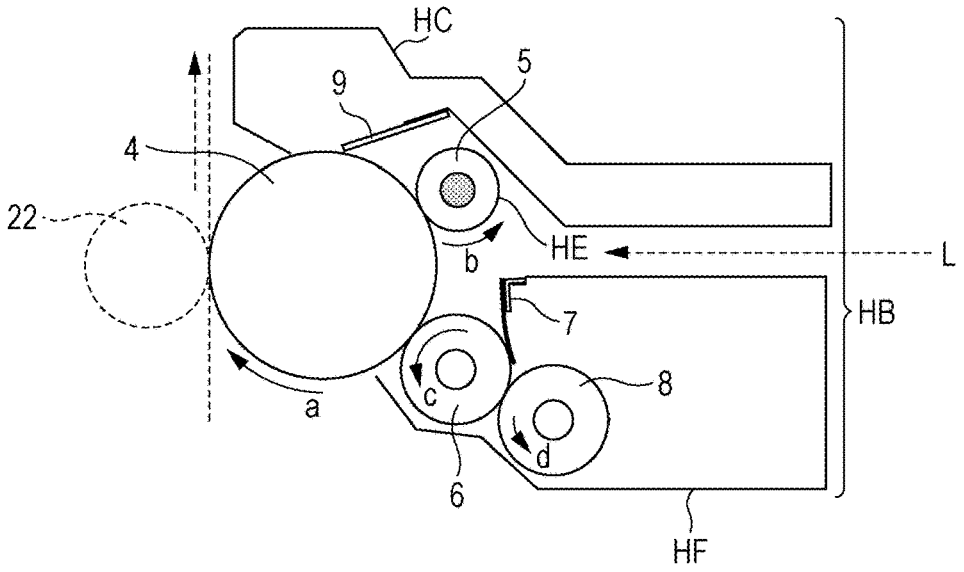
FIG. 4 shows a schematic diagram of a developing part and a transferring part, according to one or more embodiment of the subject disclosure.

The image forming apparatus HA includes a process cartridge HB of each color of yellow, magenta, cyan, and black, in which a charge device HE, a developing device HF, a cleaning device HC, and a photoconductive drum 4 are integrated as shown in FIG. 4. A toner image formed by the process cartridges HB of the individual colors is transferred to an intermediate transfer belt 20 of a transfer device, so that a full color image is formed. A step of forming an image by using the process cartridge HB will be described later in detail.

The toner images, which are to be developed, formed on the photoconductive drums 4 by the process cartridges HB of the individual colors are transferred to the intermediate transfer belt 20 by primary transfer rollers 22*y*, 22*m*, 22*c*, and 22*k* disposed at positions opposing the photoconductive drums 4 of respective colors with the intermediate transfer belt 20 therebetween. Subsequently, the resulting toner images are transferred by one operation to recording paper by a secondary roller 23 disposed on the downstream side in the movement direction of the intermediate transfer belt.

An untransferred toner on the intermediate transfer belt 20 is recovered by an intermediate transfer belt cleaner 21.

The recording paper P is stacked in a cassette 24 in a lower portion of the image forming apparatus HA and is conveyed by a feed roller 25 on the basis of a requirement for a printing operation. The toner image formed on the intermediate transfer belt 20 is transferred to the recording paper P at the position of the secondary transfer roller 23.

Thereafter, the toner image on the recording paper is heat-fixed to the recording paper by a fixing unit 26, and the resulting recording paper is discharged outside the image forming apparatus HA through the paper discharge unit 27.

In the image forming apparatus HA, an upper unit containing the detachable process cartridges HB of four colors and the like and a lower unit containing the transfer unit, the recording paper, and the like are separable from each other. When clearance of jam, e.g., paper jam, is required or when the process cartridge HB is exchanged, these treatments are performed by opening the upper and the lower units because the above-described configuration is employed.

Next, an image forming process in the process cartridge HB will be described.

FIG. 4 shows a cross section of one process cartridge HB selected from the four process cartridges HB arranged in parallel.

Regarding the photoconductive drum 4 serving as the center of the image forming process, an organic photoconductive drum 4, in which an outer peripheral surface of an aluminum cylinder is coated with an undercoat layer, a carrier generation layer, and a carrier transport layer, each serving as a functional film, in that order, may be used.

In the image forming process, the photoconductive drum 4 is driven at a predetermined speed in the direction indicated by an arrow a shown in FIG. 4 by the image forming apparatus HA.

A charge roller 5 serving as the charge device is driven to rotate in the direction indicated by an arrow b because an electrically conductive rubber roller part is pressed so as to be brought into contact with the photoconductive drum 4.

For example, −1,100 V of direct current voltage relative to the photoconductive drum 4 is applied to a core metal of the charge roller 5 and, thereby, electric charges are induced, so that the surface potential (dark area potential (Vd)) of the photoconductive drum 4 becomes −550 V uniformly.

The uniform surface charge distribution surface is irradiated with a laser beam in accordance with image data by scanner units 10*y*, 10*m*, 10*c*, and 10*k* so as to perform exposure. As indicated by an arrow L shown in FIG. 4, the photoconductive drum 4 is exposed and, in the exposed area, surface electric charges disappear because of carriers from the carrier generation layer, so that the potential is lowered.

As a result, an electrostatic latent image with, for example, an exposed portion of light-area potential V1=−100 V and an unexposed portion of dark area potential Vd=−550 V is formed on the photoconductive drum 4.

The electrostatic latent image is developed by the developing device HF including a toner coat layer which has predetermined coat amount and charge amount and which is disposed on a developing roller 6.

The developing roller 6 in contact with the photoconductive drum 4 is rotated in the forward direction indicated by an arrow c and, for example, −300 V of DC bias is applied. Meanwhile, the toner, which is negatively charged by triboelectric charging and which is borne by the developing roller 6, is transferred to only the light-area potential portion because of the potential difference so as to convert the electrostatic latent image into a real image in a developing portion in contact with the photoconductive drum 4.

The intermediate transfer belt 20 in contact with the photoconductive drums 4 of the individual process cartridges HB is pressed against the photoconductive drums 4 by the primary transfer rollers 22*y*, 22*m*, 22*c*, and 22*k* opposite to the photoconductive drums 4. A direct current voltage is applied to the primary transfer rollers 22*y*, 22*m*, 22*c*, and 22*k*, and electric fields are formed between the photoconductive drums 4 and them. Consequently, the toner image converted into the real image on the photoconductive drum 4 is transferred from the photoconductive drum 4 to the intermediate transfer belt 20 by application of the force of the electric field in a transfer region on the basis of the above-described press contact. Meanwhile, the untransferred toner which has not been transferred to the intermediate transfer belt 20 and which remains on the photoconductive drum 4 is scraped from the drum surface by an urethane rubber cleaning blade 9 disposed in the cleaning device HC and is contained into the cleaning device HC.

Regarding the developing roller 6, for example, an elastic roller, which has an outer diameter of 16 mm and in which 5 mm of electrically conductive elastic layer is disposed on a core metal having an outer diameter of 6 mm, may be used and silicone rubber having a volume resistivity of $10^6$ Ωm may be used for the elastic layer.

Regarding a supply roller 8, for example, an elastic sponge roller, which has an outer diameter of 16 mm and in which 5.5 mm of relatively low-hardness polyurethane foam having a foam skeleton structure is disposed on a core metal having an outer diameter of 5 mm, may be used.

A toner regulating member 7 serving as a toner regulating means in contact with the developing roller 6 is disposed on the downstream side of the contact surface between the supply roller 8 and the developing roller 6 in the developing roller rotational direction c. The toner regulating member serving as a developer regulating means is aimed at controlling the coat amount and the charge amount of the toner on the developing roller 6 to predetermined values suitable for development on the photoconductive drum 4.

The intermediate transfer belt 20 is composed of a base layer in the shape of a belt and a surface treated layer disposed on the base layer. The surface treated layer may be composed of a plurality of layers. Rubber, elastomers, and resins may be used for the base layer or the surface treated layer. A core having the shape of a woven fabric, a nonwoven fabric, a thread, or a film may be used for the base layer and one surface or both surfaces thereof may be coated with, be dipped into, or be sprayed with rubber, an elastomer, or a resin.

Measuring methods and evaluation methods used in the present disclosure will be described below.

(1) Evaluation of Charge Attenuation Characteristics of Charge Control Particles The charge attenuation characteristics of the charge control particles according to the present disclosure were evaluated by measuring the charge attenuation factor of the coating film on the electrically conductive substrate coated with the polymer compound constituting the charge control particles by using an apparatus which was prepared by modifying a cascade type charge amount measuring apparatus produced by KYOCERA Chemical Corporation.

Figure 5:
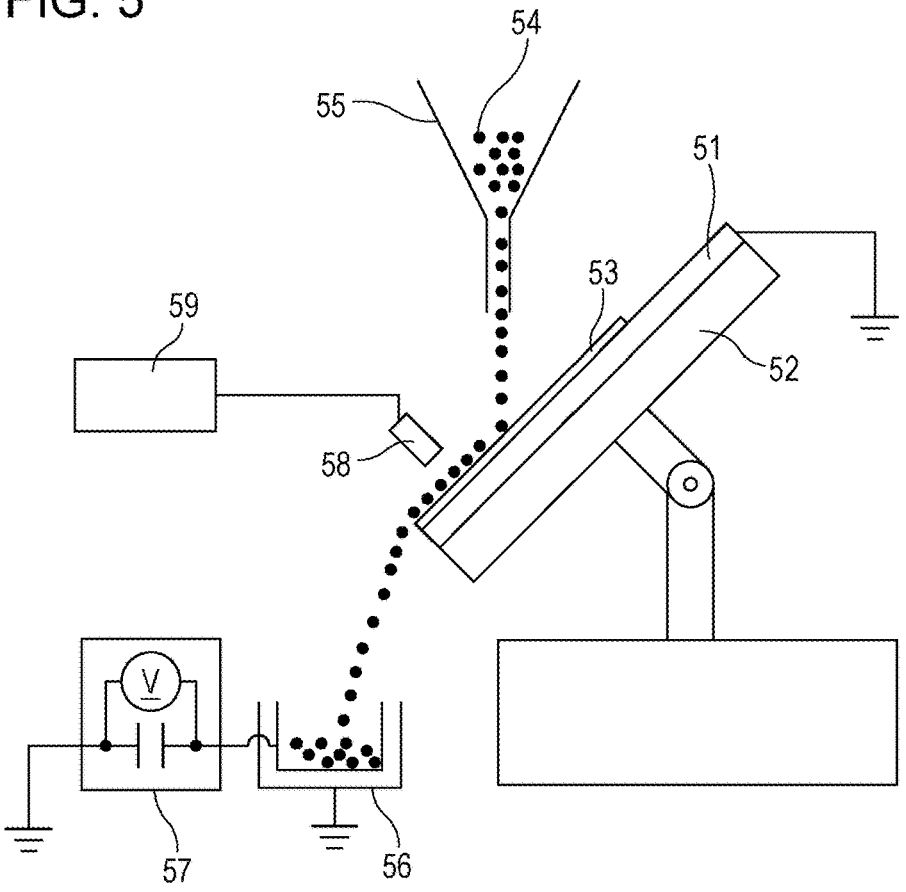
FIG. 5 shows a schematic diagram of a charge amount measuring apparatus, according to one or more embodiment of the subject disclosure.

FIG. 5 shows a schematic diagram of a charge amount measuring apparatus used in the present evaluation. In FIG. 5, reference numeral 51 denotes an electrically conductive substrate, reference numeral 52 denotes a substrate holder, reference numeral 53 denotes a polymer compound coating film, reference numeral 54 denotes a reference powder, reference numeral 55 denotes a reference powder supply device, reference numeral 56 denotes a reference powder receiver, reference numeral 57 denotes an electrometer, reference numeral 58 denotes a surface electrometer probe, and reference numeral 59 denotes a surface electrometer. Specific measuring method of the present apparatus was as described below.

1) The polymer compound constituting the charge control particles was dissolved into methyl ethyl ketone, the aluminum electrically conductive substrate 51 was coated with the coating solution by using a wire bar, and drying was performed at room temperature for 24 hours or more. At this time, the concentration of the coating solution was adjusted and the type of the wire bar was selected in such a way that the film thickness of the coating film became 3 μm.

2) The electrically conductive substrate coated with the polymer compound was left to stand for 24 hours in a measurement environment (temperature of 23° C. and relative humidity of 50%) and was attached to the substrate holder 52. The substrate holder 52 was fixed in such a way that the inclination angle of the electrically conductive substrate 51 became 45°.

3) In an environment adjusted at a temperature of 23° C. and a relative humidity of 50%, the reference powder 54 was poured on the polymer compound coating film 53 from the powder supply device 55 at a flow rate of 15 g/min. The flow path of the reference powder 54 on the polymer compound coating film 53 was adjusted to have a flow path length of 20 mm and a flow path width of 15 mm. For example, a manganese ferrite carrier (average particle diameter of 80 μm) produced by Powdertech Co., Ltd., can be used as the reference powder 54.

4) The pouring of the reference powder 54 was stopped when the surface electrometer 59 indicated −100 V, changes in the surface potential in that state was measured for 3,000 seconds, and the charge attenuation factor was calculated.

(2) Measurement of Number Average Particle Diameter (D1) of Toner Base Particles COULTER Multisizer (produced by Beckman Coulter, Inc.) was used, and an interface (produced by Nikkaki Bios Co., Ltd.) for outputting the number distribution and the volume distribution was connected to a personal computer. Sodium chloride was used as an electrolytic solution, that is, a 1% NaCl aqueous solution. For example, ISOTON R-II (produced by Beckman Coulter, Inc.) may be used. A specific measurement procedure is shown in a catalogue (February 2002) of COULTER Multisizer issued by Beckman Coulter, Inc., or an operation manual of the measuring apparatus, as described below.

Addition of 2 to 20 mg of measurement sample to 100 to 150 mL of the above-described electrolytic aqueous solution is performed. The electrolytic solution, in which the sample is suspended, is subjected to a dispersion treatment for about 1 to 3 minutes by using an ultrasonic dispersing device, and the volume and the number of toner particles of 2.0 μm or more and 64.0 μm or less are measured by using a 100 m aperture of COULTER Multisizer above. The resulting data are divided into 16 channels and the number average particle diameter D1 is determined.

(3) Measurement of Number Average Particle Diameter of Inorganic Fine Particles and Charge Control Particles Regarding the average particle diameter of the inorganic fine particles, the number average particle diameter was determined by measuring 100 or more of primary particles of inorganic fine particles present while being attached to the toner surface or being isolated in a photograph of the toner taken under magnification by using a scanning electron microscope, where comparisons are made with a photograph of the toner subjected to mapping with respect to elements contained in the inorganic fine particles by using an element analysis means, e.g., XMA, attached to the scanning electron microscope. The number average particle diameter of the charge control particles was determined by a dynamic light scattering method (measurement by using Nanotrac produced by NIKKISO CO., LTD.).

(4) Measurement of Hydrophobicity of Inorganic Fine Particles

The rate of change in mass in hydrophobicity evaluation of the inorganic fine particles employed in the present disclosure was measured by using a calorimetry measuring apparatus (Q5000SA produced by TA Instruments).

The measurement was started after about 20 mg of inorganic fine particles were placed on a sample pan and the environment in a chamber was programmed in such a way that a temperature of 23° C. and a relative humidity of 5% were held for 24 hours and, then, a temperature of 30° C. and a relative humidity of 80% were held for 1 hour. The rate of change in mass was specified as (TGA2−TGA1)×100/TGA1, where a mass 24 hours after start was specified as TGA1 and a mass after a lapse of 1 hour in an environment at a temperature of 30° C. and a relative humidity of 80% was specified as TGA2.

Meanwhile, the specific surface area was measured by a BET method on the basis of nitrogen adsorption (BET specific surface area) and the value of rate of change in mass/specific surface area was specified as an indicator of the hydrophobicity.

(5) Measurement of Toner Base Particle Coverage of Charge Control Particles

Regarding a toner base particle with charge control particles attached, locations of the charge control particles were specified while an image by using a scanning electron microscope was observed. After the locations of the charge control particles in the region of 3 μm×3 μm in the central portion of the toner base particle were specified, and the area where charge control particles were present and the area where no charge control particle was present were distinguished in the image by binarization. An area ratio of the two areas was determined on the basis of the ratio of the number of pixels in the two areas. This procedure is performed with respect to 100 or more of toner base particles and the average value thereof was specified as the coverage.

Figure 6:
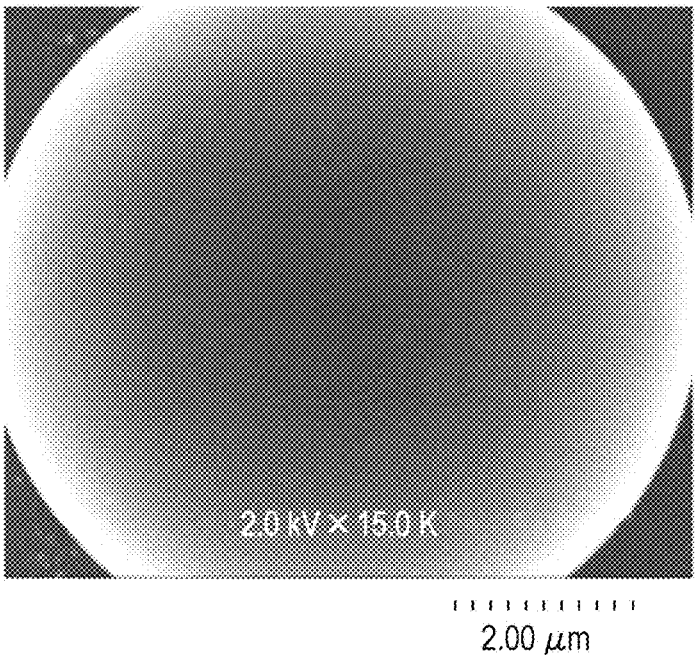
FIG. 6 shows a scanning electron microscope image of a toner base particle, according to one or more embodiment of the subject disclosure.
Figure 7:
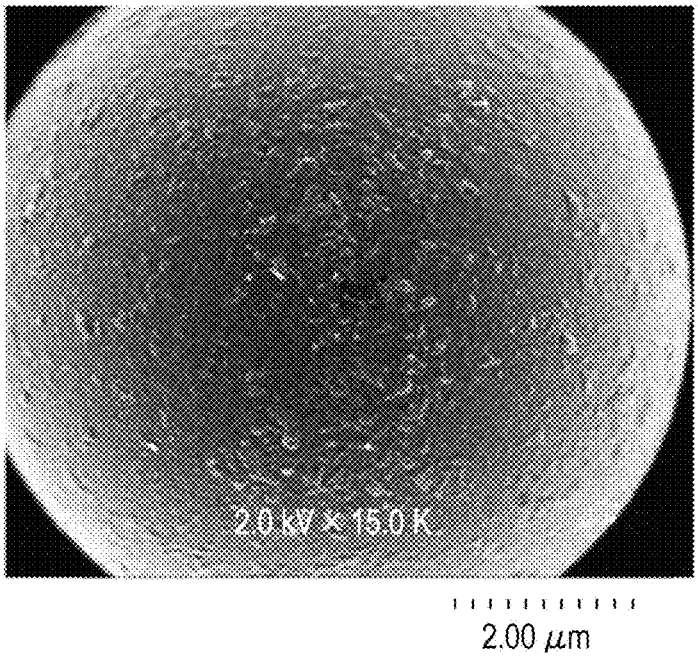
FIG. 7 shows a scanning electron microscope image of a toner base particle with charge control particles attached on the surface, according to one or more embodiment of the subject disclosure.
Figure 8:
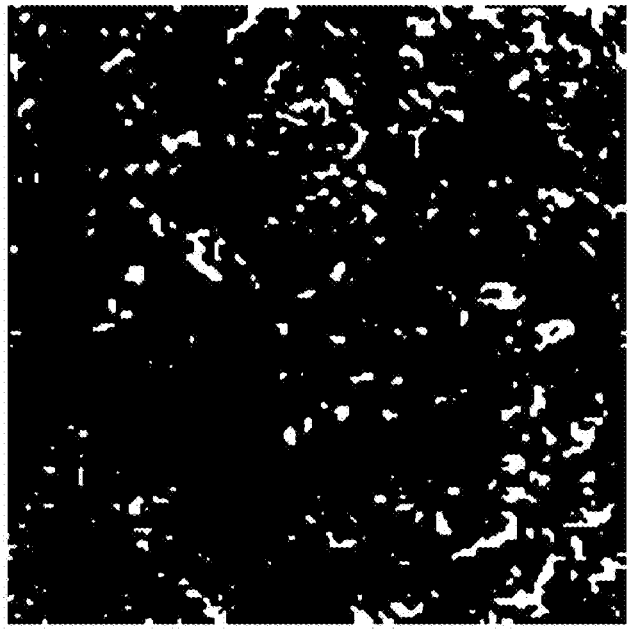
FIG. 8 shows a binarized image of a toner base particle surface with charge control particles attached thereon, according to one or more embodiment of the subject disclosure.

FIG. 6 shows a scanning electron microscope image of a toner base particle. FIG. 7 shows a scanning electron microscope image of a toner base particle with charge control particles attached. FIG. 8 shows an image in which the area where charge control particles are present and the area where no charge control particle is present are distinguished in the image by binarization after the locations of the charge control particles in the region of 3 μm×3 μm in the central portion of a toner base particle are specified.

(6) Measurement of Toner Base Particle Coverage of Inorganic Fine Particles

The central portion of a toner base particle with inorganic fine particles was photographed with an angle of view of 3 μm×3 μm under magnification by using a scanning electron microscope. The photographed image was binarized, so that the area where inorganic fine particles were present and the area where no inorganic fine particle was present were distinguished while comparisons were made with a photograph of a toner base particle with inorganic fine particle subjected to mapping with respect to elements contained in the inorganic fine particles by using an element analysis means, e.g., XMA, attached to the scanning electron microscope. An area ratio of the two areas was determined on the basis of the ratio of the number of pixels in the two areas. This procedure was performed with respect to 100 or more of toner base particles and the average value thereof was specified as the coverage.

(7) Measurement of Average Circularity of Toner Base Particles

The average circularity was used as a simple method for quantitatively expressing the shapes of particles. In the present disclosure, particles having a circle-equivalent diameter within the range of 0.60 μm to 400 μm were measured by using a flow particle imaging instrument, FPIA-3000, produced by SYSMEX CORPORATION, the circularity of each of the measured particles was determined by the following formula, $$\text{circularity } a = L_0/L$$

(in the formula, $L_0$ represents the circumference of a circle having the same project area as that of the particle image, and L represents the circumference of the particle project image subjected to image processing with image processing resolution of 512×512 (pixel of 0.3 μm×0.3 μm))

and the value produced by dividing the sum of the circularity of each of measured particles by the total number of particles was defined as the average circularity.

(8) Evaluation of Transfer Efficiency

The transfer efficiency is an indicator of the transferability and shows the percentage of toner transferred to the intermediate transfer belt in the toner developed on the photoconductive drum. The transfer efficiency was evaluated by filling a drum cartridge of a full color electrophotographic apparatus (LBP-5050 produced by CANON KABUSHIKI KAISHA) with the toner according to the present disclosure and forming cyan solid images on a recording medium continuously. After 3,000 sheets of the above-described image were formed, the proportion of the density of the toner on the intermediate transfer belt was specified as the transfer efficiency, where the sum of the density of the toner transferred to the intermediate transfer belt and the density of the toner remaining on the photoconductive drum after the transfer was specified as 100%. As this proportion increases, the transfer efficiency after endurance becomes better. In the present disclosure, the transfer efficiency was evaluated on the basis of the following criteria.

A: Very good (transfer efficiency was 98% or more)

B: Good (transfer efficiency was 95% or more and less than 98%)

C: Acceptable (transfer efficiency was 90% or more and less than 95%)

D: Poor (transfer efficiency was less than 90%)

(9) Evaluation of Fogging

Fogging was evaluated after 3,000 sheets of predetermined image are copied continuously in an environment adjusted at a temperature of 30° C. and a relative humidity of 80%.

Fogging was evaluated as described below.

The reflectivity D1(%) of five points in a white solid portion of recording paper provided with an image and the reflectivity D2(%) of five points in an unused portion of the same recording paper were measured by using a white photometer, TC-6DS/A, produced by Tokyo Denshoku Co., Ltd., and average values were calculated. The value of D1−D2 was specified as a fogging density and was evaluated on the basis of the criteria described below.

A: Very good (fogging density was less than 1.0%)

B: Good (fogging density was more than 1.0% and less than 1.5%)

C: Acceptable (fogging density was 1.5% or more and less than 2.0%)

D: Poor (fogging density was more than 2.0%)

EXAMPLES

The embodiments will be described below. The present disclosure is not limited to only the examples described below. In this regard, the term "part" in the following formulation refers to "part by mass".

Production of Charge Control Particles A

A reactor provided with a cooling tube, an agitator, a thermometer, and a nitrogen introduction tube was charged with

| | |
|---|---|
| Styrene | 100.0 parts |
| 5-Vinylsalicylic acid | 21.0 parts |
| tert-Butylperoxyisopropyl carbonate | 7.2 parts |

(PERBUTYL I-75, produced by NOF CORPORATION) Propylene glycol monomethyl ether acetate 200.0 parts and nitrogen bubbling was performed for 30 minutes. The reaction mixture was heated at 120° C. for 6 hours in a nitrogen atmosphere so as to complete the polymerization reaction. The reaction solution was cooled to room temperature and, thereafter, the solvent was removed by distillation under reduced pressure. The resulting solid was reprecipitated two times by using acetone-methanol, and drying under reduced pressure was performed at 50° C. and 0.1 kPa or less so as to obtain Charge control particles A.

It was examined by $^{1}$H NMR analysis and neutralization titration that the resulting Charge control particles A contained 10 percent by mole of units derived from 5-vinylsalicylic acid relative to all units. The weight average molecular weight (Mw) on the basis of size exclusion chromatography (SEC) analysis was 14,500. After 5 parts of Charge control particles A obtained above was dissolved into 8 parts of tetrahydrofuran (THF), 0.4 parts of N,N-dimethyl-2-aminoethanol was added, and 28 parts of pure water was dropped gradually at room temperature while agitation was performed strongly. THF was removed from the resulting dispersion liquid by distillation under reduced pressure at 50° C. so as to obtain aqueous dispersion of Charge control particles A.

The solid concentration of the dispersion was 20 percent by mass and the number average particle diameter by using the dynamic light scattering method (measurement by using Nanotrac produced by NIKKISO CO., LTD.) was 30 nm.

Production of Charge control particles B

Aqueous dispersion of Charge control particles B for comparison was produced in the same manner as production of Charge control particles A except that 6.7 parts of 2-acrylamide-2-methylpropanesulfonic acid was used instead of 5-vinylsalicylic acid.

The proportion of units derived from 2-acrylamide-2-methylpropanesulfonic acid in the resulting charge control particles was 3 percent by mole of all units, and the weight average molecular weight (Mw) was 13,500. The solid concentration of the aqueous dispersion was 20 percent by mass and the number average particle diameter by using the dynamic light scattering method was 32 nm.

Production of Charge Control Particles C

Aqueous dispersion of Charge control particles C was produced in the same manner as production of Charge control particles A except that 28.2 parts of 3-tert-butyl-5-vinylsalicylic acid was used instead of 5-vinylsalicylic acid.

The proportion of units derived from 3-tert-butyl-5-vinylsalicylic acid in the resulting charge control particles was 10.3 percent by mole of all units, and the weight average molecular weight (Mw) was 12,300. The solid concentration of the aqueous dispersion was 20 percent by mass and the number average particle diameter by using the dynamic light scattering method was 30 nm.

Production of Charge Control Particles D

Aqueous dispersion of Charge control particles D was produced in the same manner as production of Charge control particles A except that 25.4 parts of 4-chloro-5-vinylsalicylic acid was used instead of 5-vinylsalicylic acid.

The proportion of units derived from 4-chloro-5-vinylsalicylic acid in the resulting charge control particles was 9.8 percent by mole of all units, and the weight average molecular weight (Mw) was 14,800. The solid concentration of the aqueous dispersion was 20 percent by mass and the number average particle diameter by using the dynamic light scattering method was 31 nm.

Example 1

Production of Toner Base Particles

Polymerizable Monomer Composition Preparation Step

The following composition was mixed and, thereafter, was dispersed for 3 hours in a ball mill.

| | |
|---|---|
| Styrene | 82.0 parts |
| 2-Ethylhexyl acrylate | 18.0 parts |
| Divinylbenzene | 0.1 parts |
| C.I. Pigment Blue 15:3 | 5.5 parts |
| Polyester resin | 5.0 parts |

(polycondensate of propylene oxide modified bisphenol A and isophthalic acid (glass transition temperature of 65° C., weight average molecular weight (Mw) of 10,000, and number average molecular weight (Mn) of 6,000)

The resulting dispersion liquid was transferred to a reactor provided with propeller agitation blades, and heating to 60° C. was performed under agitation at a rotation speed of 300 rpm. Thereafter, 12.0 parts of ester wax (peak temperature of a maximum endothermic peak of 70° C. in DSC measurement and number average molecular weight (Mn) of 704) and 3.0 parts of 2,2'-azobis(2,4-dimethylvaleronitrile) were added and were dissolved so as to prepare a polymerizable monomer composition.

Dispersion Medium Preparation Step

After 710 parts of ion-exchanged water and 450 parts of 0.1 mol/L-sodium phosphate aqueous solution were put into a 2-L four-necked flask provided with a high speed agitator, T.K. HOMOMIXER (produced by PRIMIX Corporation), and heating to 60° C. was performed under agitation at a rotation speed of 12,000 rpm. An aqueous dispersion medium containing calcium phosphate as a fine water-insoluble dispersion stabilizer was prepared by adding 68.0 parts of 1.0 mol/L-calcium chloride aqueous solution.

Granulation and Polymerization Step

The polymerizable monomer composition was put into the aqueous dispersion medium, and granulation was performed for 15 minutes while the rotation speed of 12,000 rpm was maintained. Subsequently, the agitator was switched from the high speed agitator to propeller agitation blades, polymerization was continued at an internal temperature of 60° C. for 5 hours, the internal temperature was raised to 80° C., and the polymerization was made to continue for further 3 hours. After the polymerization reaction was finished, remaining monomers were removed by distillation under reduced pressure at 80° C., and cooling to 30° C. was performed so as to obtain a polymer fine particle dispersion liquid.

Washing Step

The polymer fine particle dispersion liquid was transferred to a washing container, and pH was adjusted to 1.5 by adding dilute hydrochloric acid under agitation. After the dispersion liquid was agitated for 2 hours, solid-liquid separation was performed with a filter so as to obtain polymer fine particles. The polymer fine particles were put into 1,200 parts of ion-exchanged water, agitation was performed so as to prepare a dispersion liquid again, and solid-liquid separation was performed with a filter. This operation was repeated three times so as to obtain toner base particles. The resulting toner base particle had a number average particle diameter D1 of 6.5 μm and an average circularity of 0.93.

Step of Attaching Charge Control Particles to Toner Base Particle

The toner base particles were transferred into an anionic surfactant aqueous solution, and the toner base particles were dispersed so as to obtain a dispersion liquid having a solid concentration of 5.0 percent by mass. An aqueous dispersion (0.95 parts) of Charge control particles A was added relative to 100.0 parts of solid content of the resulting dispersion liquid and agitation was performed. In addition, dilute hydrochloric acid was added under agitation so as to adjust the pH to 0.95 and, thereby, Charge control particles A were coagulated and were made to adhere to the surfaces of the toner base particles.

Washing and Drying Step

The water in the resulting dispersion liquid was separated by filtration with a filter. The residue was put into 1,200 parts of ion-exchanged water, agitation was performed so as to prepare a dispersion liquid again, and solid-liquid separation was performed with a filter. This operation was repeated three times and, thereafter, particles finally obtained by solid-liquid separation were sufficiently dried at 30° C. by a drier so as to obtain particles in which charge control particles were attached to the toner base particles. FIG. 6 shows a scanning electron microscope image of the toner base particle before Charge control particles A were attached. FIG. 7 shows an image after Charge control particles A were attached to the surface of the toner base particle. FIG. 8 shows an image in which the area where charge control particles are present and the area where no charge control particle is present are distinguished by binarization. The coverage of the charge control particles on the basis of area ratio calculation was 10%.

Inorganic Fine Particle Attachment Step

Toner particle were obtained by adding 1.4 parts of Inorganic fine particles E (silica having a number average particle diameter of primary particles of 100 nm and a rate of change in mass/specific surface area of 0.048% g/m$^2$) to 100.0 parts of the resulting particles, in which charge control particles were attached to toner base particles, and performing dry mixing and agitation for 5 minutes with a Henschel mixer (produced by NIPPON COKE & ENGINEERING CO., LTD.).

Fluidity Improver Attachment Step

A toner was obtained by dry-mixing 1.0 parts of fluidity improver (silica having a number average particle diameter of primary particles of 7 nm) surface-treated with hexamethylsilazane into 100.0 parts of the resulting toner particles for 5 minutes with the Henschel mixer.

Example 2

The present example was basically in conformity with Example 1, and different points were as described below. The coverage of the charge control particles was specified as 0.02% by specifying the amount of addition of the aqueous dispersion of Charge control particles A as 0.00185 parts. The coverage of Inorganic fine particles E was specified as 0.6% by specifying the amount of addition of Inorganic fine particles E as 0.08 parts.

Example 3

The present example was basically in conformity with Example 1, and different points were as described below. The coverage of the charge control particles was specified as 0.05% by specifying the amount of addition of the aqueous dispersion of Charge control particles A as 0.00465 parts. The coverage of the inorganic fine particles was specified as 0.5% by specifying the amount of addition of Inorganic fine particles E as 0.068 parts.

Example 4

The present example was basically in conformity with Example 1, and different points were as described below. The coverage of the charge control particles was specified as 0.1% by specifying the amount of addition of the aqueous dispersion of Charge control particles A as 0.0095 parts. The coverage of the inorganic fine particles was specified as 0.3% by specifying the amount of addition of Inorganic fine particles E as 0.041 parts.

Example 5

The present example was basically in conformity with Example 1, and different points were as described below. The coverage of the charge control particles was specified as 15% by specifying the amount of addition of the aqueous dispersion of Charge control particles A as 1.4 parts. The coverage of the inorganic fine particles was specified as 10% by changing Inorganic fine particles E to Inorganic fine particles F (silica having a number average particle diameter of primary particles of 90 nm and a rate of change in mass/specific surface area of 0.048% g/m$^2$) and specifying the amount of addition as 1.22 parts.

Example 6

The present example was basically in conformity with Example 1, and a different point was as described below. The coverage of the inorganic fine particles was specified as 10% by changing Inorganic fine particles E to Inorganic fine particles G (silica having a number average particle diameter of primary particles of 110 nm and a rate of change in mass/specific surface area of 0.048%-g/m$^2$) and specifying the amount of addition as 1.5 parts.

Example 7

The present example was basically in conformity with Example 1, and different points were as described below. The coverage of the charge control particles was specified as 50% by specifying the amount of addition of the aqueous dispersion of Charge control particles A as 4.62 parts. The coverage of the inorganic fine particles was specified as 50% by specifying the amount of addition of the inorganic fine particles E as 6.8 parts.

Example 8

The present example was basically in conformity with Example 1, and different points were as described below. The coverage of the charge control particles was specified as 55% by specifying the amount of addition of the aqueous dispersion of Charge control particles A as 5.0 parts. The coverage of the inorganic fine particles was specified as 55% by specifying the amount of addition of the inorganic fine particles E as 7.5 parts.

Example 9

The present example was basically in conformity with Example 1, and a different point was as described below. The coverage of the inorganic fine particles was specified as 0.4% by specifying the amount of addition of the inorganic fine particles E as 0.055 parts.

Example 10

The present example was basically in conformity with Example 9, and a different point was as described below. The coverage of the inorganic fine particles was specified as 0.2% by specifying the amount of addition of the inorganic fine particles E as 0.027 parts.

Example 11

The present example was basically in conformity with Example 9, and a different point was as described below. The coverage of the inorganic fine particles was specified as 50% by specifying the amount of addition of the inorganic fine particles E as 6.8 parts.

Example 12

The present example was basically in conformity with Example 11, and a different point was as described below. The coverage of the inorganic fine particles was specified as 60% by specifying the amount of addition of the inorganic fine particles E as 8.2 parts.

Example 13

The present example was basically in conformity with Example 1, and a different point was as described below. The coverage of the Charge control particles was specified as 80% by changing Charge control particles A to Charge control particles C and specifying the amount of addition as 7.4 parts.

Example 14

The present example was basically in conformity with Example 1, and a different point was as described below. The coverage of the Charge control particles was specified as 85% by changing Charge control particles A to Charge control particles C and specifying the amount of addition as 7.85 parts.

Example 15

Step of Preparing Aqueous Dispersion Liquid of Binder Resin

The following composition was mixed and was dissolved.

| | |
|---|---|
| Styrene | 82.6 parts |
| n-Butyl acrylate | 9.2 parts |
| Acrylic acid | 1.3 parts |
| Hexanediol acrylate | 0.4 parts |
| n-Lauryl mercaptan | 3.2 parts |

An aqueous solution composed of 1.5 parts of NEOGEN RK (produced by Dai-ichi Kogyo Seiyaku Co., Ltd.) and 150 parts of ion-exchanged water was added to the resulting solution and was dispersed. In addition, an aqueous solution composed of 0.15 parts of potassium persulfate and 10 parts of ion-exchanged water was added over 10 minutes under mild agitation. After nitrogen purge was performed, emulsion polymerization was performed at 70° C. for 6 hours. After the polymerization was finished, the reaction solution was cooled to room temperature and ion-exchanged water was added so as to obtain a binder resin particle dispersion liquid having a solid concentration of 12.5 percent by mass and a median diameter of 0.2 μm on a volume basis. In this regard, the median diameter on a volume basis of the binder resin particle dispersion liquid was measured by using a dynamic light scattering particle size analyzer (Nanotrac produced by NIKKISO CO., LTD.).

Step of Preparing Aqueous Dispersion Liquid of Wax

A wax dispersion liquid was obtained by mixing 100 parts of ester wax (peak temperature of a maximum endothermic peak of 70° C. in DSC measurement and Mn of 704) and 15 parts of NEOGEN RK into 385 parts of ion-exchanged water and performing dispersion for about 1 hour by using a wet jet mill, JN 100 (produced by JOKOH CO., LTD.). The concentration of the wax particle dispersion liquid was 20 percent by mass, and the median diameter on a volume basis by using the dynamic light scattering method was 0.2 μm.

Step of Preparing Aqueous Dispersion Liquid of Colorant Particles

A colorant particle dispersion liquid was obtained by mixing 100 parts of C.I. Pigment Blue 15:3 and 15 parts of NEOGEN RK into 885 parts of ion-exchanged water and performing dispersion for about 1 hour by using a wet jet mill, JN 100 (produced by JOKOH CO., LTD.).

The median diameter on a volume basis of the colorant particles by using the dynamic light scattering method was 0.2 μm. The concentration of the dispersion liquid was 10 percent by mass.

Coagulation and Fusion Step

After 160 parts of the binder resin particle dispersion liquid, 10 parts of the wax dispersion liquid, 10 parts of the colorant dispersion liquid, and 0.2 parts of magnesium sulfate were dispersed by using a homogenizer (ULTRA-TURRAX T50 produced by IKA), heating to 65° C. was performed under agitation. Agitation was performed at 65° C. for 1 hour. After 2.2 parts of NEOGEN RK (produced by Dai-ichi Kogyo Seiyaku Co., Ltd.) was added, the temperature was raised to 80° C. and agitation was performed for 120 minutes so as to obtain a fused toner base particle dispersion liquid. At this time, the number average particle diameter D1 of the toner base particles was about 6.5 pun and the average circularity was 0.90.

The resulting toner base particles were subjected to the charge control particle attachment step, the washing and drying step, inorganic fine particle attachment step, and the fluidity improver attachment step as with Example 1 so as to obtain a toner of Example 15. In this regard, Charge control particles D were used as the charge control particles.

Comparative Example 1

The present comparative example was basically in conformity with Example 1, and different points were as described below.

The coverage of the charge control particles was specified as 0.02% by specifying the amount of addition of the aqueous dispersion of Charge control particles A as $1.85\times10^{-3}$ parts. The coverage of Inorganic fine particles E was specified as 0.3% by specifying the amount of addition of Inorganic fine particles E as 0.041 parts.

Comparative Example 2

The present comparative example was basically in conformity with Example 1, and different points were as described below.

The coverage of the charge control particles was specified as 0.04% by specifying the amount of addition of the aqueous dispersion of Charge control particles A as $3.7\times10^{-3}$ parts. The coverage of Inorganic fine particles was specified as 0.25% by specifying the amount of addition of Inorganic fine particles E as 0.034 parts.

Comparative Example 3

The present comparative example was basically in conformity with Example 1, and different points were as described below.

The coverage of the charge control particles was specified as 0.1% by specifying the amount of addition of the aqueous dispersion of Charge control particles A as $9.5\times10^{-3}$ parts. The coverage of Inorganic fine particles was specified as 0.1% by specifying the amount of addition of Inorganic fine particles E as 0.014 parts.

Comparative Example 4

The present comparative example was basically in conformity with Example 1, and a different point was as described below.

Inorganic fine particles were not added.

Comparative Example 5

The present comparative example was basically in conformity with Example 1, and different points were as described below.

The coverage of the charge control particles was specified as 15% by specifying the amount of addition of the aqueous dispersion of Charge control particles A as 1.4 parts. Inorganic fine particles E was changed to Inorganic fine particles H (silica having a number average particle diameter of primary particles of 80 nm and a rate of change in mass/specific surface area of 0.043%·g/m$^2$).

Comparative Example 6

The present comparative example was basically in conformity with Example 1, and different points were as described below.

The coverage of the charge control particles was specified as 15% by specifying the amount of addition of the aqueous dispersion of Charge control particles A as 1.4 parts. Inorganic fine particles E was changed to Inorganic fine particles I (silica having a number average particle diameter of primary particles of 100 nm and a rate of change in mass/specific surface area of 0.062%-g/m$^2$).

Comparative Example 7

The present comparative example was basically in conformity with Example 1, and a different point was as described below.

Charge control particles were not added.

Comparative Example 8

The present comparative example was basically in conformity with Example 1, and different points were as described below.

The coverage of the charge control particles was specified as 15% by specifying the amount of addition of the aqueous dispersion of Charge control particles A as 1.4 parts. Charge control particles B having a charge attenuation factor of 11% were added.

Comparative Example 9

The present comparative example was basically in conformity with Example 2, and a different point was as described below.

Inorganic fine particles E was changed to Inorganic fine particles H (silica having a number average particle diameter of primary particles of 80 nm and a rate of change in mass/specific surface area of 0.043%·g/m$^2$).

Comparative Example 10

The present comparative example was basically in conformity with Example 3, and a different point was as described below.

Inorganic fine particles E was changed to Inorganic fine particles I (silica having a number average particle diameter of primary particles of 100 nm and a rate of change in mass/specific surface area of 0.062%·g/m$^2$).

Comparative Example 11

The present comparative example was basically in conformity with Example 4, and a different point was as described below.

Charge control particles B having a charge attenuation factor of 11% were added.

A drum cartridge of a full color electrophotographic apparatus (LBP-5050 produced by CANON KABUSHIKI KAISHA) was filled with the thus produced toner, 3,000 sheets of cyan solid image were formed on a recording medium continuously and, thereafter, the transfer efficiency was measured. Likewise, after 3,000 sheets of predetermined image were copied continuously in an environment adjusted at a temperature of 30° C. and a relative humidity of 80%, fogging was evaluated. The results thereof are shown in Table.

TABLE

| | Inorganic fine particle | | | Charge control particle | | | Toner base particle | |
|---|---|---|---|---|---|---|---|---|
| | Type | Number average particle diameter $r_b$ (μm) | Hydrophobicity (rate of change in mass/specific surface area) (% · g/m$^2$) | Type | Number average particle diameter $r_c$ (μm) | Charge attenuation factor (%) | coverage of inorganic fine particles $H_b$ (%) | Coverage of charge control particles $H_c$ (%) |
| Example 1 | E | 0.10 | 0.048 | A | 0.030 | 2 | 10 | 10 |
| Example 2 | E | 0.10 | 0.048 | A | 0.030 | 2 | 0.60 | 0.02 |
| Example 3 | E | 0.10 | 0.048 | A | 0.030 | 2 | 0.50 | 0.05 |
| Example 4 | E | 010 | 0.048 | A | 0.030 | 2 | 0.30 | 0.10 |
| Example 5 | F | 0.09 | 0.022 | A | 0.030 | 2 | 10 | 15 |
| Example 6 | G | 0.12 | 0.035 | A | 0.030 | 2 | 10 | 10 |
| Example 7 | E | 0.10 | 0.048 | A | 0.030 | 2 | 50 | 50 |
| Example 8 | E | 0.10 | 0.048 | A | 0.030 | 2 | 50 | 60 |
| Example 9 | E | 0.10 | 0.048 | A | 0.030 | 2 | 0.40 | 10 |
| Example 10 | E | 0.10 | 0.048 | A | 0.030 | 2 | 0.20 | 10 |
| Example 11 | E | 0.10 | 0.048 | A | 0.030 | 2 | 50 | 10 |
| Example 12 | E | 0.10 | 0.048 | A | 0.030 | 2 | 60 | 10 |
| Example 13 | E | 0.10 | 0.048 | C | 0.030 | 3 | 10 | 80 |
| Example 14 | E | 0.10 | 0.048 | C | 0.030 | 3 | 10 | 85 |
| Example 15 | E | 0.10 | 0.048 | D | 0.031 | 7 | 10 | 10 |
| Comparative example 1 | E | 0.10 | 0.048 | A | 0.030 | 2 | 0.30 | 0.02 |
| Comparative example 2 | E | 0.10 | 0.048 | A | 0.030 | 2 | 0.25 | 0.04 |
| Comparative example 3 | E | 0.10 | 0.048 | A | 0.030 | 2 | 0.10 | 0.10 |
| Comparative example 4 | — | — | — | A | 0.030 | 2 | 0 | 10 |
| Comparative example 5 | H | 0.08 | 0.043 | A | 0.030 | 2 | 10 | 15 |
| Comparative example 6 | I | 0.10 | 0.062 | A | 0.030 | 2 | 10 | 15 |
| Comparative example 7 | E | 0.10 | 0.048 | — | — | — | 10 | 0 |
| Comparative example 8 | E | 0.10 | 0.048 | B | 0.032 | 13 | 10 | 15 |
| Comparative example 9 | H | 0.08 | 0.043 | A | 0.030 | 2 | 0.60 | 0.02 |
| Comparative example 10 | I | 0.10 | 0.062 | A | 0.030 | 2 | 0.50 | 0.05 |
| Comparative example 11 | E | 0.10 | 0.048 | B | 0.032 | 13 | 0.30 | 0.10 |

| | Toner base particle | | | | | | |
|---|---|---|---|---|---|---|---|
| | Sum total of coverages (%) | Number average particle diameter R (μm) | Average circularity | Relationship of Formula (1) Yes/No | Relationship of Formula (2) Yes/No | Transfer efficiency | Fogging |
| Example 1 | 20 | 6.5 | 0.93 | Y | Y | A | A |
| Example 2 | 0.62 | 6.5 | 0.93 | Y | Y | B | B |
| Example 3 | 0.55 | 6.5 | 0.93 | Y | Y | B | B |
| Example 4 | 0.40 | 6.5 | 0.93 | Y | Y | B | B |
| Example 5 | 25 | 6.5 | 0.93 | Y | Y | B | A |
| Example 6 | 20 | 6.5 | 0.93 | Y | Y | A | A |
| Example 7 | 100 | 6.5 | 0.93 | Y | Y | A | B |
| Example 8 | 110 | 6.5 | 0.93 | Y | Y | B | C |
| Example 9 | 10.40 | 6.5 | 0.93 | Y | Y | B | A |
| Example 10 | 10.20 | 6.5 | 0.93 | Y | N | C | A |
| Example 11 | 60 | 6.5 | 0.93 | Y | Y | A | A |
| Example 12 | 70 | 6.5 | 0.93 | Y | N | B | C |
| Example 13 | 90 | 6.5 | 0.93 | Y | Y | B | A |
| Example 14 | 95 | 6.5 | 0.93 | Y | Y | B | C |
| Example 15 | 20 | 6.5 | 0.90 | Y | Y | B | C |
| Comparative example 1 | 0.32 | 6.5 | 0.93 | N | Y | B | D |
| Comparative example 2 | 0.29 | 6.5 | 0.93 | N | Y | B | D |
| Comparative example 3 | 0.20 | 6.5 | 0.93 | N | N | D | D |
| Comparative example 4 | 10 | 6.5 | 0.93 | — | — | D | A |
| Comparative example 5 | 25 | 6.5 | 0.93 | Y | Y | D | A |
| Comparative example 6 | 25 | 6.5 | 0.93 | Y | Y | D | D |
| Comparative example 7 | 10 | 6.5 | 0.93 | — | Y | D | D |
| Comparative example 8 | 25 | 6.5 | 0.93 | Y | Y | D | D |
| Comparative example 9 | 0.62 | 6.5 | 0.93 | Y | Y | D | B |
| Comparative example 10 | 0.55 | 6.5 | 0.93 | Y | Y | D | D |
| Comparative example 11 | 0.40 | 6.5 | 0.93 | Y | Y | D | D |

As is clear from Example 1, Example 5, Example 6, and Comparative example 5, in the case where the average particle diameter of the inorganic fine particles was 90 nm or more, the results of both the transfer efficiency and the fogging after endurance were good. This is because if the average particle diameter is less than 90 nm, the inorganic fine particles are buried under the surfaces of the toner base particles by endurance and a sufficient spacer effect is not exerted after the endurance.

As is clear from Example 2 to Example 4 and Comparative example 1 to Comparative example 3, in the case where the coverage of inorganic fine particles and the coverage of charge control particles satisfy Formula (1) specified in the present disclosure, the results of both the transfer efficiency and the fogging after endurance were good. In this regard, other examples also satisfied Formula (1).

As is clear from Example 7 and Example 8, the results of the transfer efficiency and the fogging after endurance were better in the case where the sum total of the coverages was 100% or less. This is because in the case where the sum total of the coverages is specified as 100% or less, inorganic fine particles are not isolated easily and the charge is stabilized. Although the reason for this is not certain, the following are considered. In the case where the charge signs of the charge control particles and the inorganic fine particles are the same, when the inorganic fine particles are externally added, the inorganic fine particles are attached directly to the toner base particles so as to avoid the charge control particles. However, in the case where the sum total of coverages is more than 100%, the inorganic fine particles are not possible to avoid the charge control particles and are attached from above the charge control particles, so that the inorganic fine particles are brought into a state of being isolated easily.

As is clear from Example 9 and Example 10, in the case where the lower limit of the coverage of the inorganic fine particles satisfies Formula (2) specified in the present disclosure, a better transfer efficiency was obtained. In the case where the coverage of the inorganic fine particles is more than the lower limit specified in Formula (2), a spacer effect of the inorganic fine particles is sufficiently obtained and the transfer efficiency is further increased.

As is clear from Example 11 and Example 12, in the case where the upper limit of the coverage of the inorganic fine particles satisfies Formula (2) specified in the present disclosure, the results of both the transfer efficiency and the fogging after endurance were good. This is because in the case where the coverage of the inorganic fine particles is less than the upper limit specified in Formula (2), it is possible to suppress isolation of the inorganic fine particles and stabilize the charge.

As is clear from Example 13 and Example 14, in the case where the coverage of the charge control particles was specified as 80% or less, it was possible to suppress isolation of the charge control particles and obtain higher charge stability.

As is clear from Example 1 and Example 15, in the case where the average circularity of the toner base particles was specified as 0.93 or more, the results of both the transfer efficiency and the fogging after endurance were good.

As is clear from Comparative example 4, in the case where inorganic fine particles were not attached, the fluidity improver was buried under the surfaces of the toner base particles by endurance and a sufficient spacer effect was not exerted, so that the transfer efficiency after the endurance was degraded.

As is clear from Comparative example 6, in the case where the hydrophobicity of the inorganic fine particles was more than 0.05 (% g/m$^2$), electric charges were diffused through the inorganic fine particles, so that sufficient charge was not obtained and it was unable to stabilize the charge.

As is clear from Comparative example 7, in the case where charge control particles were not attached, toner did not have sufficient chargeability and both the transfer efficiency and the fogging after endurance were degraded.

As is clear from Comparative example 8, in the case where the charge attenuation factor of the charge control particles was more than 10%, electric charges were diffused through the charge control particles, so that sufficient charge was not obtained and it was unable to stabilize the charge.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-095774, filed May 8, 2015, which is hereby incorporated by reference herein in its entirety.

What is claimed is:

1. A toner, in which inorganic fine particles and charge control particles are present on the surfaces of toner base particles, wherein an average circularity of the toner base particles is 0.93 or more, the inorganic fine particles satisfy the following conditions i) and ii), i) the number average particle diameter is 90 nm or more, ii) the value produced by dividing the rate of change in the mass of the inorganic fine particles by the specific surface area of the inorganic fine particles is 0.05 (%·g/m$^2$) or less, wherein the rate of change in the mass of the inorganic fine particles is calculated by a following formula:

$$(TGA2-TGA1)\times 100/TGA1$$

in the formula, the mass of the inorganic fine particles, which are left to stand for 24 hours or more in an environment at a temperature of 23° C. and a relative humidity of 5%, is defined "TGA1", and the mass of the inorganic fine particles, which are further left to stand for 1 hour in an environment at a temperature of 30° C. and a relative humidity of 80%, is defined "TGA2", the charge control particles are a polymer compound, the polymer compound has at least a partial structure represented by General formula (1), General formula (1)

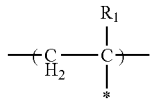

in General formula (1), $R_1$ represents a hydrogen atom or an alkyl group, and * represents a bonding site for bonding to a structure represented by General formula (2), General formula (2)

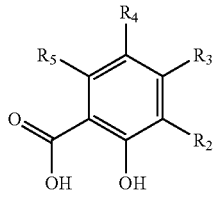

in General formula (2), $R_2$ to $R_5$ represent independently a hydrogen atom, an alkyl group having a carbon number of 1 to 6, a halogen atom, a cyano group, a nitro group, or a partial structure represented by General formula (1), at least one of $R_2$ to $R_5$ is the partial structure represented by General formula (1), the charge control particles have the charge attenuation factor of 10% or less, wherein the charge attenuation factor is evaluated by measuring a charge attenuation factor of the coating film on an electrically conductive substrate, the coating film is obtained by coating the polymer compound being dissolved into methyl ethyl ketone on the electrically conductive substrate, the toner base particle coverage Hb, which is a coverage ratio of a surface of the toner base particle with the inorganic fine particles, is 10.0% to 50.0%, the toner base particle coverage Hc, which is a coverage ratio of a surface of the toner base particle with the charge control particles, is 10.0% to 80.0%, and a sum of Hb and Hc is 20.0% to 90.0%.

* * * * *